United States Patent [19]

Bukala

[11] 4,320,369

[45] Mar. 16, 1982

[54] ELECTRICAL RELAY DEVICE AND METHOD OF MAKING THE SAME

[75] Inventor: Alexander E. Bukala, Chicago, Ill.

[73] Assignee: Littelfuse, Inc., Des Plaines, Ill.

[21] Appl. No.: 113,580

[22] Filed: Jan. 21, 1980

[51] Int. Cl.[3] ..... H01H 50/02

[52] U.S. Cl. ..... 335/202; 335/128; 335/133; 200/283

[58] Field of Search ..... 335/202, 128–132, 335/133, 134; 200/283, 284; 339/194 R; 29/622

[56] References Cited

U.S. PATENT DOCUMENTS

| | | | |
|---|---|---|---|
| 2,519,121 | 8/1950 | Del Camp | 339/194 R |
| 3,087,136 | 4/1963 | Peterson et al. | 339/194 R |
| 4,112,399 | 9/1978 | Pracher et al. | 335/202 |

*Primary Examiner*—Harold Broome

*Attorney, Agent, or Firm*—Wallenstein, Wagner, Hattis, Strampel & Aubel

[57] ABSTRACT

An electrical device, which preferably forms a plug-in relay unit, includes a terminal board assembly most advantageously formed by a pair of insulating plates made of thermoplastic material and between which are clamped the intermediate laterally extending portions of terminal blade members having outer portions projecting transversely beyond the outermost plate constituting a base plate and transversely innermost portions projecting beyond the innermost plate constituting a clamp plate. One or more of the terminal blade members carry stationary contacts on the inner ends thereof. The insulating plates are held secured together and a bobbin assembly having thermoplastic pins are passed through apertures in the base assembly and ultrasonically vibrated to weld the same to the walls of the apertures. A core and heel piece sub-assembly is initially mounted for progressive movement upon the bobbin assembly and anchored in place in a given position thereon where the core section thereof projects beyond a core-receiving aperture of the bobbin assembly a given predetermined distance. The core and heel piece sub-assembly includes a core section adjustably mounted in a predetermined position upon a heel piece section before it is mounted on the bobbin assembly. An armature with a movable contact is pivotally mounted on the end of the heel piece section for movement toward and away from the projecting core section.

28 Claims, 11 Drawing Figures

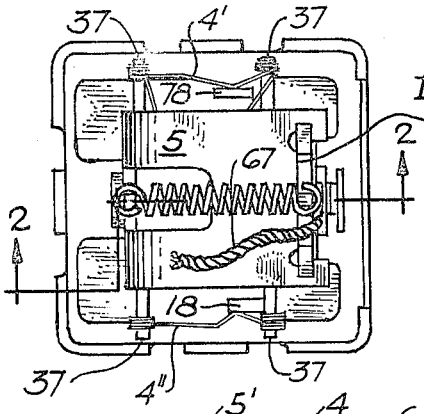
FIG. 3
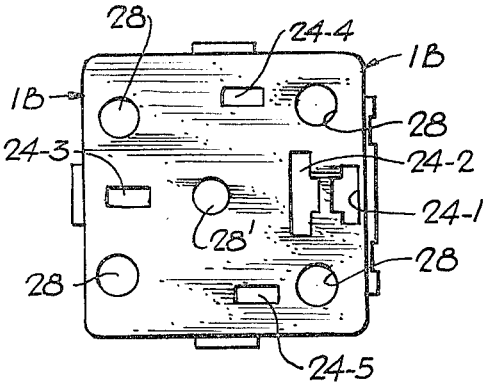
FIG. 4
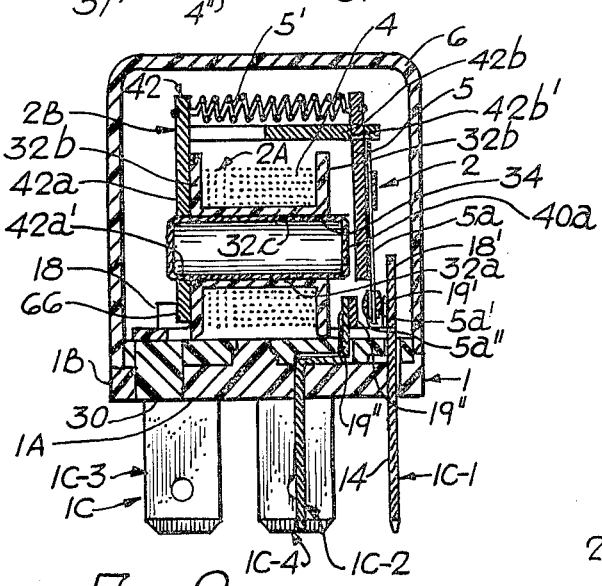
FIG. 2
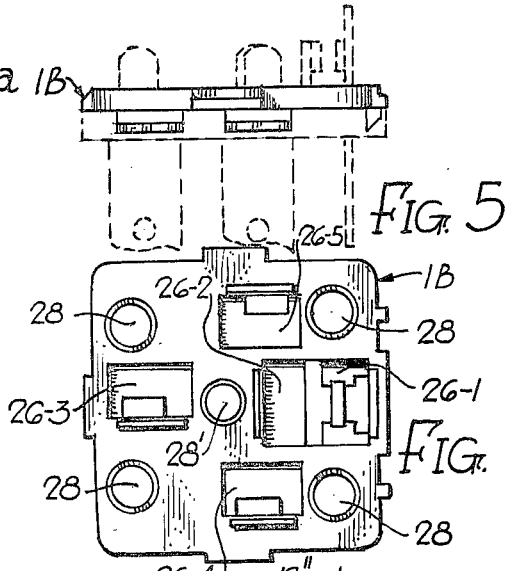
FIG. 5
FIG. 6
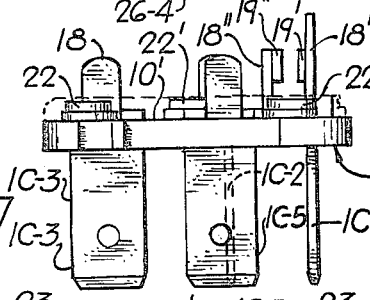
FIG. 7
FIG. 9
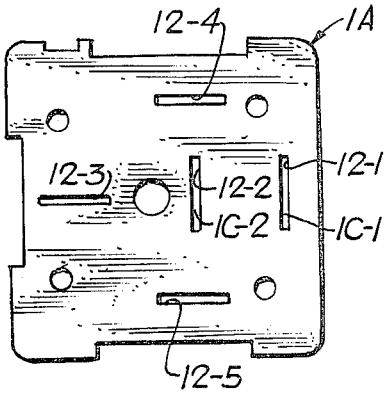
FIG. 8
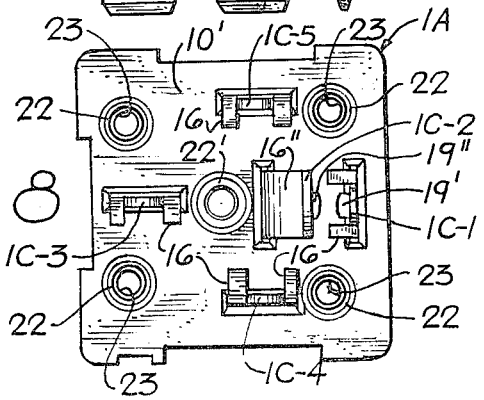

ELECTRICAL RELAY DEVICE AND METHOD OF MAKING THE SAME

BACKGROUND OF INVENTION

The present invention relates to a unique electrical device and a method of making the same, which device and method have their most important, but not only, utility in the manufacture of plug-in relays commonly used in automobiles.

Plug-in relays have been made for many years in a manner which is not adaptable to completely automated mass projection techniques. As is common in the manufacture of all types of relays and other electromagnetic devices, unless the parts thereof are made to extremely close and therefore expensive tolerances, some manual adjustment or machining operation has generally been required to finally produce an electromagnetic device which meets the customer's specifications. The manufacture of relays for automobile applications requires the seemingly incompatible requirements of low unit cost with high reliability. With the relay design and manufacturing techniques heretofore utilized, a 75% acceptable yield on the completed relays coming off the assembly line was considered highly satisfactory.

There has been an obvious need to decrease the unit cost of such relays without sacrificing their reliability. The present invention has provided a unique design of and method of making a plug-in relay or the like which produce acceptable yields well in excess of 90%, and at a lower unit cost of manufacture than previous designs, because of the unique relay design involved which makes possible a unique fully automated assembly and adjustment procedure which does not require close tolerances of the parts.

SUMMARY OF THE INVENTION

In accordance with one of the features of the present invention, the relay or other electromagnetic device has a bobbin structure which carries a conductor winding forming a coil encircling a core-receiving aperture. Unlike the prior art bobbin structures which are associated with a non-adjustable magnetic field-directing structure, in accordance with one aspect of the invention the bobbin structure is designed to receive a core and heel piece unit which is initially adjustable in position on the bobbin structure. While the core and heel piece unit could be made from a single piece of magnetic material, it is preferably an adjustable assembly of a cylindrical core element made of a low carbon steel alloy or other suitable magnetic material, adjustably disposed with a press fit within an aperture in an end portion of a heel piece also made of magnetic material and completing the magnetic field-directing structure of the electromagnetic device involved. In the latter case, the cylindrical core is adjusted in position within the end portion of the heel piece prior to its placement upon the bobbin structure so that the outer end of the core is precisely located with respect to the adjacent end of the heel piece, using fully automated gauging techniques. The core and heel piece unit is then mounted upon the bobbin structure so that the core section thereof passes adjustably through said core-receiving aperture of the bobbin structure. The core and heel piece unit is adjusted in position on the bobbin structure so that the outer end of the core projects a desired precise degree from one end of this core-receiving aperture. A gauge block may be utilized for this purpose where, by fully automated means, the coil and heel piece unit is pushed against the gauge block against which the bobbin structure is braced. The finally adjusted position of the core and heel piece unit is fixed as by soldering or welding a portion thereof to a metal part of the base of the electromagnetic device.

With such a construction and method of assembly of a core and heel piece assembly upon a bobbin structure, identically perfectly operating relays or other electromagnetic devices can be mass-produced at very low cost, since an almost 100% acceptable yeild can be obtained in a fully automated assembly and adjustment procedure which does not require parts made to very close tolerances.

In accordance with another feature of the invention which both reduces the size and assembly cost of a plug-in relay or other plug-in electrical device, a unique support base construction is provided. Thus, instead of fabricating a support base therefor in a conventional way, where terminal blade members are staked or riveted in position on an insulating base or are incorporated in the insulating base during the molding thereof, the support base comprises a pair of insulating plates between which are clamped the terminal blade members. The bottom or outer insulating plate, sometimes referred to as a base plate, has spaced apertures into which the terminal blade members may be dropped from the inner or upper face thereof, so that the terminal blade members project outwardly or downwardly from the same. The inner or upper insulating plate, sometimes referred to as a clamp plate, confronts laterally extending intermediate portions of the terminal blade members which extend along the confronting inner faces of the insulating plates, where these portions are clamped securely in place by the insulating plates. The terminal blade members have upper end portions projecting through apertures in the clamp plate where some form contact terminal tabs for soldering the ends of conductors leading from the electrical device involved, such as terminals of a coil. By varying the configuration of the terminal blade members and the position of the apertures in the base plate, it can be seen that a variety of different terminal blade member patterns can be produced, as is generally required by different automobile manufactures, while enabling the standardization of the clamp plate, if desired, and relay design. This construction allows the full area of the base and clamp plates to route the terminals involved, unlike the prior art base construction where the terminals must extend around rivets, crimp tabs and the like.

As a further feature of the invention, the bobbin structure is secured to the base and clamp plates by anchoring pins made of thermoplastic material depending from the base portion of the electrical device involved. These plates are also made of a thermoplastic material. These anchoring pins extend transversely from laterally extending portions of the support frame for the electrical device which form ultrasonic tool-receiving surfaces. The pins preferably are tapered so as to be readily passable into apertures of bases which secure together the base and clamp plates. An ultrasonic tool is then momentarily applied to these ultrasonic tool-receiving surfaces to melt the pins and the material of the base and clamp plates immediately surrounding the apertures, so that the bases and the pins are welded together.

The above described and other features of the invention can be best understood by making reference to the specification to follow and the drawings which shows an exemplary and preferred form of the invention as applied to plug-in relays.

DESCRIPTION OF DRAWINGS

FIG. 2 is a vertical sectional view through the plug-in relay unit formed by the parts shown in FIG. 1, but with the housing added thereto, such sectional view being that which would be seen along the section planes identified by reference numerals 2—2 in FIG. 3;

FIG. 3 is a view of the relay of FIG. 2 as would be seen looking down upon the same with the housing removed therefrom;

FIG. 4 is a view looking up toward the upper insulating or clamp plate of the base and terminal assembly portion of the relay shown in FIGS. 1 through 3, but with all of the other parts of the relay removed from the assembly;

FIG. 5 is an end elevational view of the clamp plate, with the associated parts thereof shown in dashed lines;

FIG. 6 is a view of the inner or bottom surface of the clamp plate shown in FIGS. 4 and 5;

FIG. 7 is an end elevational view of the bottom or base plate of the terminal assembly of the relay and shows the terminal blade members mounted thereon prior to the assembly of the clamp plate thereof;

FIG. 8 is a view of the base plate and terminal blade members of FIG. 7, as viewed when looking down upon the same;

FIG. 9 is a view of the bottom of the base plate shown in FIGS. 7 and 8, with the terminal blade members removed therefrom;

DESCRIPTION OF EXEMPLARY FORM OF THE INVENTION SHOWN IN DRAWINGS

Figures 1, 10, 11:
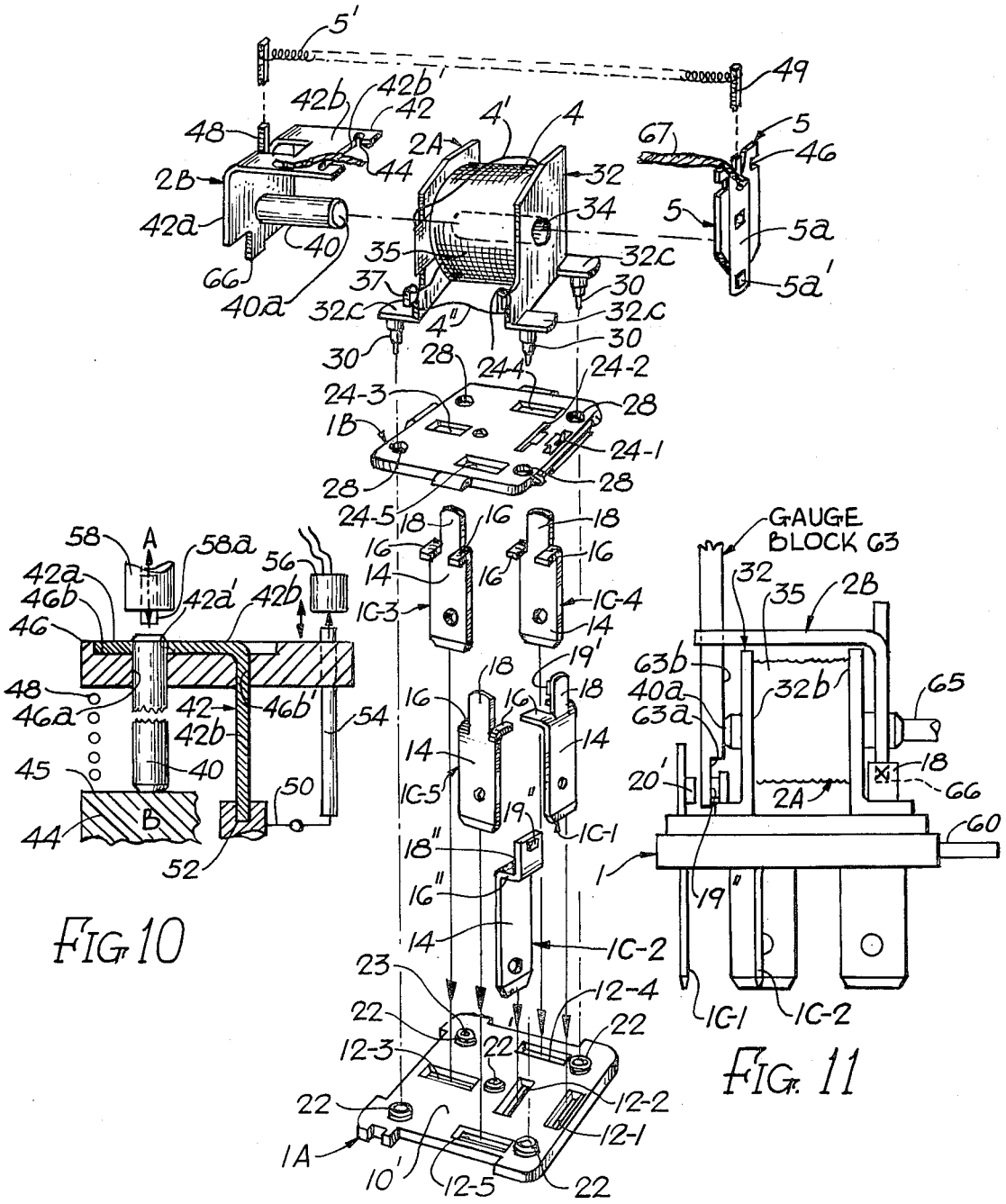
FIG. 1 is an exploded view which illustrates the various parts making up a basic plug-in relay, except for the housing which is not shown therein, the drawing including lines which show the relationship of the various parts after their assembly.
FIG. 10 is a view illustrating the manner in which the core section of the core and heel piece sub-assembly of the relay shown in FIGS. 1 through 3 is adjusted in position on the heel piece section of the sub-assembly.
FIG. 11 illustrates the manner in which the core and heel piece sub-assembly is precisely positioned upon the bobbin structure portion of the relay of FIGS. 1 through 3.

Referring now more particularly to FIGS. 2 and 3, which show the present invention applied to a plug-in relay, the relay includes what may be referred to as a terminal board assembly 1 upon which is mounted a relay forming unit 2 formed by a bobbin assembly including a bobbin structure 2A and a coil 4 wound thereon. The bobbin assembly has mounted thereon a core and heel piece sub-assembly 2B. A contact-carrying armature 5 is pivotally mounted on the end of the heel piece section of the core and heel piece sub-assembly 2B where it is urged by a spring 5' into a given position best illustrated in FIG. 2. The relay-forming unit 2 is enclosed within a suitable housing 6 interlocked in any suitable way with the terminal board assembly 1. The novelty of the relay illustrated, as previously summarized, deals both with the unique construction of the support base for the plug-in relay which comprises a terminal board assembly 1 first to be described, and also with the construction and arrangement of the core and heel piece sub-assembly 2B upon the bobbin structure 2A. In the description of the relay now to be given, references to the orientation and relationship of the various parts will be explained on the assumption that the relay is orientated as shown in FIG. 2, with the terminal board assembly at the bottom of the relay. It should be understood, however, that the relay could have other orientations in which event what is described as a bottom or upper part or surface may in fact have some other orientation.

The terminal board assembly 1 comprises a bottom insulating piece 1A, to be referred to as a base plate, an upper insulating plate 1B, to be referred to as a clamp plate, and terminal blade members 1C which are clamped between the base plate 1A and clamp plate 1B in a manner to be described. These plates are preferably made of a thermoplastic material. The relay illustrated in a single pole double-throw relay which requires five electrical connections thereto. Accordingly, there are five terminal blade members 1C-1, 1C-2, 1C-3, 1C-4 and IC-5, as best shown in FIG. 1, which have terminal blade-forming portions 14 which project downwardly and transversely from the bottom surface of the base plate 1A through apertures 12-1, 12-2, 12-3, 12-4 and 12-5 therein. These terminal blade-forming portions 14 are adapted to extend within a suitable socket connector (not shown) having socket-forming terminals adapted to make good electrical contact with the terminal blade-forming portions 14 of the various terminal blade members. The terminal blade members 1C-3, 1C-4 and IC-5 have upper fingers 18 which project upwardly through the clamp plate 1B to form terminal tabs to which are physically and electrically connected conductors or conductor-forming members to be described.

The terminal blade members 1C-1 and 1C-2 are stationary contact-carrying members having upwardly extending fingers 18' and 18", finger 18', as illustrated, forming a coplanar extension of the terminal blade-forming portions 14 of the terminal blade members 1C-1 and finger 18" being parallel to but offset from the associated terminal blade-forming portion 14. The contact-carrying fingers 18' and 18" of the terminal blade members 1C-1 and 1C-2 project upwardly and transversely through apertures 24-1 and 24-2 of the clamp plate 1B and carry stationary contact-forming elements 19' and 19" which are in spaced confronting relationship to one another above the clamp plate 1B, as shown best in FIG. 2. The armature 5, which is made of a suitable magnetic material, carries a metal contact plate 5*a* which extends between the fingers 18' and 18" of the terminal blade members 1C-1 and 1C-2 and includes contact elements 5*a*' and 5*a*" on the opposite sides thereof. When the relay is de-energized, the contact element 5*a*' makes contact with the stationary contact element 19' of the terminal blade member 1C-1, and when the relay is energized the contact element 5*a*' leaves the contact element 19' and the contact element 5*a*" makes contact with the stationary contact element 19" of the terminal blade member 1C-2. In a manner to be described, the terminal blade member 1C-3 makes electrical connection with the armature 5 and establishes a point of electrical connection of the contact elements 5*a*' and 5*a*" of the armature 5 with a circuit external to the relay. The terminal blade members 1C-4 and 1C-5 make electrical connection with the ends 4' and 4" of coil 4 mounted on the bobbin structure 2B.

All of the terminal blade members 1C have laterally extending intermediate portions which extend along the upper or inner face 10' of the base plate 1A to form portions which are engaged by the confronting surfaces of the base plate 1A and clamp plate 1B. The laterally extending intermediate portions of the terminal blade members 1C-1, 1C-3, 1C-4 and 1C-5 are formed by tabs 16 extending laterally from the upper ends of the terminal blade-forming portions 14 thereof on the opposite sides of the base portions of the associated upper fingers 18, as best shown in FIG. 1. The laterally extending intermediate portion of the terminal member 1C-2 is a bridging wall portion 16" which interconnects the upper offset finger 18" and the associated terminal blade-forming portion 14 of the terminal blade member 1C-2.

In the form of the invention shown in the drawings, the laterally extending portions 16 and 16" of the terminal blade members 1C extend along the flat upper surface 10' of the base plate 1A. Consequently, to enable a desired face-to-face contact of the inner surfaces of the base and clamp plates 1A and 1B either the inner surface of the base plate or clamp plate 1B should be provided with recesses 26-1, 26-2 . . . 26-5 shown on the bottom surface of clamp plate 1B for respectively receiving the laterally extending portions 16 and 16" of the terminal blade members 1C-1, 1C-2 . . . 1C-5.

The particular orientation and position of these apertures and the intermediate laterally extending and terminal blade-forming portions of the various terminal blade members can vary widely, depending upon the specifications for a particular plug-in relay, while the upper fingers 18, 18' and 18" thereof could remain in the identical positions shown, so that the clamp plate and relay assembly elements could be standardized. (To standardize the clamp plate, the recesses 26-1, 26-2 . . . 26-3 should be on the inner surface of the base plate 1A, rather than on the clamp plate as illustrated.)

Projecting upwardly from the upper surface of the plate 1A are pin-receiving bosses 22 having pin-receiving holes 23 extending through the base plate 1A. These bosses are adapted to fit when softened within correspondingly shaped apertures 28 formed in the clamp plate 1B. An upwardly extending positioning boss 22' also projects upwardly from the upper surface of the base plate 1A which boss fits when softened within a corresponding aperture 28' in the clamp plate.

In the assembly of the support base and terminal assembly 1, the various terminal blade members 1C-1, 1C-2 . . . 1C-5 are respectively dropped into the associated apertures 12-1, 12-2 . . . 12-5 in the base plate 1A from the top thereof. The clamp plate 1B is then placed over the base plate so that the upper fingers 18, 18' and 18" extend through the corresponding apertures 24-1, 24-2 . . . 24-5 in the clamp plate 1B. Instead of utilizing metal rivets or the like for securing together the base and clamp plates 1A and 1B, the confronting surfaces of the base and clamp plates 1A and 1B made of thermoplastic material are welded together as by applying an ultrasonic tool to the entire upper face of the clamp plate 1B which also softens the bosses 22 and 22' initially somewhat wider than the apertures 28 and 28' in the clamp plate. The bosses 22 and 22' enter the apertures 28 and 28' under pressure of the ultrasonic tool and become welded to the defining walls thereof. Tapered anchoring or securing pins 30 on the bottom of the frame 32 of the bobbin structure 24 are then extended into the boss holes 23 which still remain. The pins 30 are preferably made of a thermoplastic material molded as an integral part of the bobbin structure frame 32. The pins are tapered and project downwardly from four laterally extending legs 32*c* at the four corners of the frame 32, the legs 32*c* having exposed upper surfaces adapted to receive four nose portions of an ultrasonic tool (not shown). The pins 30 taper in a downward direction, so that the bottom ends thereof initially fit readily through the boss holes 23 of the base plate 1A but finally make a snug fit therein. The ultrasonic tool is then brought down upon the upper surface of the legs 32*c* of the bobbin structure frame 32 to cause the pins 30 and the defining walls of the boss holes 23 to soften and flow together simultaneously to weld the pins 30 to the bosses 22.

The bobbin structure frame 32 has a cylindrical center portion 32*c* extending between end walls 32*b*—32*b* thereof. The cylindrical center portion 32*c* defines a core-receiving aperture 34 through which extends a cylindrical core 40 of the core and heel piece sub-assembly 2B. The core 40 extends from the end wall portion 42*a* of the heel piece section 42 of the sub-assembly 2B which, like the core 40, is made of a suitable magnetic material. The core and heel piece sub-assembly 2B is initially mounted for adjustment upon the bobbin structure 2A so that the degree to which the end of the core projects from the core-receiving aperture 34 is progressively variable. As illustrated, the core 40 is press-fitted within an aperture 42*a*' formed in the heel piece end wall 42*a* and, in such case, prior to the mounting of the subassembly 2B upon the bottom structure, the core 40 is adjusted in position in the heel piece end wall aperture 42*a*' so that its end face 40*a* is spaced a desired distance from the end face 42*b*' of the opposite end of a longitudinally extending heel piece portion 42*b*. When the sub-assembly 2B is subsequently mounted upon the bobbin structure 32, the longitudinally extending heel piece portion 42*b* extends along the upper side of the bobbin structure 32 as viewed in the drawings.

Mounted on the outside of the cylindrical center portion 32*c* of the frame 32 is the coil 4 formed of windings of conductive wire. The ends 4' and 4" of this coil are shown respectively wound around pairs of anchoring projections 37—37 positioned on opposite sides of the bobbin structure frame 32. These coil ends are soldered to the adjacent terminal blade member fingers 18—18 on the terminal blade members 1C-4 and 1C-5 which are located on opposite sides of the bobbin structure frame.

The armature 5 is pivotally mounted against the end face 42*b*' on the end of the longitudinally extending portion 42*b* of the heel piece 42 remote from the end wall portion 42*a* thereof. The latter end of the heel piece portion 42*b* has a cut-out portion 47 into which fits a complimentary portion 46 of the armature 5 so that the armature 5 can be pivotally mounted therein. The aforementioned spring 5', which extends between an anchoring tab 48 on the heel piece end wall 42*a* and an anchoring tab 49 on the armature 4, initially urges the armature 5 into a position where the movable contact element 5*a*' carried thereby contacts stationary contact element 19' on the finger 18' of the terminal blade member 1C-1. As previously indicated, when current above a given value flows through the coil 4, a magnetic force is developed which will attract the magnetic material out of which the armature 5 is made so that the movable contact element 5*a*" thereof first engages the stationary contact element 19" of the terminal blade member 1C-2 and then deflects the same as it contacts the end face 40*a* of the core. Proper contact pressure between contact elements 5*a*″ and 19″ are assured by the precise positioning of the core end face 40*a* with the location of stationary contact element 19″.

Refer now to FIG. 10 which shows an exemplary test fixture arrangement which permits the automatic positioning of the core 40 within the aperture 42*a*′ on the end wall 42*a* of the heel piece 42. The fixture includes a base block 44 having an outer surface 45 against which the end of the core 40 is to be braced. The core 40 is shown extending through an opening 46*a* in a plate 46 urged by a spring 48 away from the surface 45. The spring-loaded plate 46 has a recess or nest 46*b* into which fits the end wall 42*a* of the heel piece 42. The heel piece 42 is placed within the net 46*b* so that its aperture 42*a*′ fits over the end of the core 40 and the longitudinally extending portion 42*b* of the heel piece projects through an opening 46*b*′ in the spring loaded plate and the end face 42*b*′ thereof abuts the end wall of a socket of a plunger 52. The plunger 52 is connected to one end of a lever 50 pivoted intermediate its ends and whose opposite end is connected to a plunger 54 initially spaced from a reference transducer 56. When the end of the plunger 54 strikes the transducer 56, a control operation is carried out to be described.

A plunger 58 is provided having depending therefrom a spring loaded pin 58*a* which initially engages the outer end of the core 40 and is retracted within the plunger 58 as the plunger moves downwardly against the end wall 42*a* of the heel piece 42. As the plunger 58 is brought downwardly toward the heel piece end wall 42*a*, it presses the heel piece downwardly over the core 40 and causes the heel piece end wall 42*a* to move along the stationary core 40. This movement of the heel piece 42 will cause the spring loaded plate 46 to move toward the surface 45 of the base block 44 until the plunger 54, which moves upwardly as the plunger 52 moves downwardly, strikes the transducer 56. The resulting signal generated by the transducer 56 will terminate the downward movement of the plunger 58 which then returns to its initial position. The assembly procedure just described will position the end of the core 40 a fixed distance from the outer face 42*b*′ of the longitudinally extending portion 42*b* of the heel piece 42. The adjusted assembly of the core 40 and the heel piece 42 is then extracted from the fixture shown in any suitable way, as by operation of a suitable ejecting means (not shown).

Refer now to FIG. 11 which illustrates the manner in which the core and heel piece sub-assembly 2B is automatically positioned on the bobbin structure 2A in accordance with a preferred adjustment procedure. When the core and heel piece sub-assembly 2B is initially mounted on the bobbin structure 2A as shown in FIG. 11, the terminal board assembly 1 with the bobbin structure thereon is pushed by a spring loaded plunger 60 toward a reference surface 63*a* of a gauge block 63, so that the stationary contact element 19″ on terminal block member 1C-2 engages this surface. At the same time, a spring-loaded plunger 65 presses against the inner end of the core 40 projecting a short distance from the end wall 42*a* of the heel piece 42, so that the core and heel piece sub-assembly 2B is pushed toward the gauge block 63 where the end face 40*a* of the core 40 engages a gauge block reference surface 63*b* spaced a given reference distance from the gauge block surface 63*a*. This procedure is carried out before the armature 5 is mounted upon the end of the heel piece 42.

When the core and heel piece assembly 2B have been so positioned and before the same is withdrawn from the gauge block 63, an anchoring tab 66 projecting from the bottom end of the heel piece end wall 42*a* is soldered, welded or otherwise anchored to the terminal tab-forming finger 18 of the terminal blade member 1C-3. Since the heel piece 42 is made of a conductive material, the connection of the heel piece 42 to the terminal tab-forming finger 18 of the terminal blade member 1C-3 acts as a conductive path which is connected to the movable contact-carrying plate 5*a* of the armature 5 by a cable 67 whose opposite ends are respectively soldered to the heel piece portion 42*b* and the movable contact-carrying plate 5*a* of the armature 5.

It should be apparent that the most preferred form of the invention provides a plug-in relay having a number of unique advantages over the prior art about which I am aware, one of which is that it can be readily assembled from relatively inexpensive parts and by fully automated means into a satisfactory operating relay by fully automated adjusting means in the manner described. Also, the unique design of the support base and terminal assembly described not only lends itself to a very efficient and fully automated assembly operation as described, but the design enables the support base to be of minimum size since the means which anchor the electromagnetic device involved upon the support base is coextensive with the securing means for the base and clamp plates 1A and 1B which retain the terminal blade members in place without the use of staking or riveting means previously utilized to anchor terminal members in place on a support base.

It should be understood that where the claims refer to a core and heel piece unit, such expression is intended to cover such a unit where the core and heel piece is formed as a single non-adjustable integral body made of magnetic material, or where the unit comprises separate core and heel pieces and the core piece is adjustably mounted upon the heel piece, as described. Also, while the core and heel piece unit adjustability feature of the invention has its most important application to relays where contact pressure and armature spacing requirements are critical specifications, the present invention is also useful, although to a much lesser degree, in solenoids. Additionally, the terminal board assembly construction of the invention has application to any plug-in electrical device.

It should be understood that numerous modifications may be made in the most preferred form of the invention described without deviating from the broader aspects of the invention.

I claim:

1. In an electrical plug-in unit including a support base, terminal blade members projecting from said support base, and an electromagnetic device on said support base, the improvement wherein said support base includes an outer insulating base plate with spaced apertures into which the terminal blade members have been inserted from the inner face of said base plate to project beyond the same, said terminal blade members having laterally projecting portions extending along said inner face of the base plate, and an inner insulating clamp plate, some of said terminal blade members projecting through said clamp plate to form terminal lugs, electrical conductors extending from said electromagnetic device to said terminal lugs on said terminal blade members; and securing means both interconnecting and securing together said base plate and clamp plate so that said laterally projecting portions of said terminal blade members are sandwiched and clamped between said base and clamp plates and permanently anchoring said device to said support base.

2. The electrical plug-in unit of claim 1 wherein said electromagnetic device is a relay with a coil having its ends electrically connected to a pair of said terminal members, and at least one stationary contact and a movable contact operated by the magnetic field generated by said coil, said contacts being electrically connected to another pair of said terminal members.

3. The electrical plug-in unit of claim 1, wherein said electromagnetic device includes a support frame structure with anchoring pins passing through apertures in at least said clamp plate to form said securing means which at least secure said device to said support base.

4. The electrical plug-in unit of claim 3 wherein said aligned portions of said base and clamp plates initially define apertures and said anchoring pins are made of thermoplastic material which when melted flows into said apertures and when cooled forms a secure bond with the defining walls of said apertures.

5. The electrical plug-in unit of claim 4 wherein said base and clamp plates are made of thermoplastic material, said anchoring pins project from laterally extending portions of said support frame structure which portions form ultrasonic tool-receiving surfaces which, when ultrasonically vibrated, caused said anchoring pins and the surrounding material of said aperture defining walls to melt and form an integral welded structure.

6. In an electromagnetic device including a support base having a bobbin structure thereon supporting a conductor winding forming a coil having end portions for receiving energizing current for the coil, said bobbin structure having a core-receiving aperture passing through said bobbin structure and encircled by said coil, the improvement comprising a magnetic-field directing structure for said coil for carrying the magnetic field generated by current flowing in said coil, the magnetic field-directing structure comprising a core and heel piece unit having a core section and a heel piece section, said core and heel piece unit being initially adjustably mounted on said bobbin structure so that said core section extends into one end of said core-receiving aperture and is initially progressively adjustable in position therein until finally anchored in place, said core section of said core and heel piece unit extending from an end wall portion of said heel piece section adjacent one end of said bobbin structure and passing through said core-receiving aperture to project beyond the other end thereof, said core section being initially slidably disposed in an aperture in said end wall portion to vary the distance said core section projects beyond said end wall portion, said heel piece section having a longitudinal portion extending from said end wall portion thereof, and said longitudinal portion of said core and heel piece unit extending on the outside of said bobbin structure to the other end of said bobbin structure so that the adjustability of said core section in said end wall portion can precisely determine the axial displacement between the end of said core section and the end of the longitudinal portion of the heel piece section; and an armature mounted for movement between an initial position which it assumes when said coil is de-energized and a position against the projecting portion of said core section when drawn thereagainst by the magnetic field in said core section when the coil is energized.

7. The electromagnetic device of claim 6 wherein said electromagnetic device is a relay and said armature carries a movable contact of the relay and said support base carries a stationary contact engageable by said movable contact.

8. The electromagnetic relay device of claim 7 wherein said movable contact, when said armature is drawn toward said core section by current flow in said coil, first engages said stationary contact before the armature engages said core section.

9. The electromagnetic device of claim 6 wherein said device is a plug-in device where said support base carries terminal blade members projecting outwardly therefrom, said support base includes an outer insulating base plate with spaced apertures into which the terminal blade members have been inserted from the inner face of said base plate to project beyond the same, said terminal blade members having laterally projecting portions extending along said inner face of the base plate and an inner insulating clamp plate, securing means interconnecting and securing together said base plate and clamp plate so that said laterally projecting portions of said terminal blade members are sandwiched and clamped between said base and clamp plates, said terminal blade members projecting through said clamp plate to form terminal lugs, and conductors extending from said coil to said terminal lugs on said terminal blade members.

10. The electromagnetic device of claim 6 or 7 wherein said core section of said core and heel piece unit is adjustably mounted in said heel piece section so that the degree to which it projects therefrom is adjustable.

11. The electromagnetic device of claim 9 wherein said electrical device is a relay device with at least one stationary contact on said support base and a movable contact on said armature moved by the magnetic field generated by said coil, said stationary and movable contacts being electrically connected to the terminal lugs of another pair of said terminal blade members.

12. The electromagnetic device of claim 6 or 9 wherein said armature is mounted for movement on the end of said heel piece section of the core and heel piece unit adjacent said other end of said core-receiving aperture of said bobbin structure toward and away from said core section projecting therefrom.

13. The electromagnetic device of claim 9 wherein said electromagnetic device is a relay and said armature carries a movable contact of the relay, and there is provided at least one stationary contact on the terminal lug of one of said terminal blade members with which stationary contact the movable contact on said armature makes contact in one of the extreme positions of the armature.

14. The electromagnetic relay device of claim 11 wherein the means for anchoring said core and heel piece unit in its adjusted position is a terminal lug of one of said terminal blade members to which terminal lug a portion of said heel piece section of said core and heel piece unit is soldered or welded, and the electrical connection of said movable contact to one of said terminal blade members is through said terminal lug.

15. The electromagnetic device of claim 9 wherein said bobbin structure has projecting from the inner side thereof anchoring pins passing through apertures in at least said clamp plate and anchoring said bobbin structure thereto.

16. The electromagnetic device of claim 15 wherein said anchoring pins are made of thermoplastic material which was melted to flow into said apertures and when cooled formed a secure bond with the defining walls of said apertures.

17. The electromagnetic device of claim 16 wherein said base and clamp plates are made of thermoplastic material, said anchoring pins project from laterally extending portions of said support frame structure which portions form ultrasonic tool-receiving surfaces which, when ultrasonically vibrated, cause said anchoring pins and the surrounding material of said aperture defining walls to melt and form an integral welded structure.

18. A method of making an electromagnetic device, said method including the steps of: providing an insulating base plate with spaced terminal blade member-receiving apertures therein; placing individual terminal blade members into said apertures from above said base plate so that the bottom end portions of the terminal blade members project downwardly from the base plate, the terminal blade members laterally projecting intermediate portions extending along the upper face of the base plate and upwardly projecting upper end portions; providing an insulating clamp plate upon which an electromagnetic device is to be supported, said clamp plate having apertures through which said upper end portions of said terminal blade members may extend; placing said clamp plate upon said laterally projecting intermediate portions of said terminal blade members by passing said apertures thereof over said upper end of said terminal blade members; providing an electromagnetic device, placing said device on said clamp plate and electrically connecting conductors extending from said device to the upper end portions of said terminal blade members; and permanently securing together said base and clamp plates so that said laterally projecting intermediate portions of said terminal blade members are clamped between said base and clamp plates and permanently securing said device upon the clamp plate.

19. The method of claim 20 wherein said electromagnetic device has a base portion from which depend pins which are to constitute a securing means, at least said clamp plate having apertures through which said pins may pass; and passing said depending pins through said aligned apertures of said clamp plate, and then forming said pins into securing means for anchoring said device to said clamp plate.

20. The method of claim 18 wherein at least the portions of said clamp plate surrounding said apertures are made of thermoplastic material, said depending anchoring pins are also made of a thermoplastic material and fit snugly into said apertures, said pins extend downwardly from laterally extending base portions of said electrical device, the upper surfaces of said laterally extending portions forming ultrasonic heat tool-receiving surfaces, and momentarily applying an ultrasonic tool to said surfaces as said anchoring pins are passed through said apertures so that the material which forms said pins and the defining walls of said aligned apertures are melted to weld said clamp plates and pins together when the thermoplastic material cools.

21. A method of making an electromagnetic device including a support base having a bobbin structure thereon supporting a conductor winding forming a coil and having a core-receiving aperture passing through said bobbin structure and encircled by said coil, a magnetic field-directing structure for said device including a core in said aperture for carrying the magnetic field generated by the current in said coil, and an armature mounted opposite one end of said core-receiving aperture for movement between an initial position when said coil is de-energized and a position against said core when drawn by the magnetic field generated in said core when the coil is energized, the method comprising: providing a support base having a bobbin structure thereon supporting a conductor winding forming a coil and having a core-receiving aperture passing through said bobbin structure and encircled by said coil; providing a core and heel piece unit constituting said magnetic field-directing structure, said core and heel piece unit including a core section and a heel piece section from which said core section extends; said heel piece section of said core and heel piece unit including an end portion adjacent the end of said core section projects and a longitudinal portion extended from said end wall portion to the opposite end of said bobbin structure, said core section being of constant cross section and slidable in a similarly sized aperture in said heel piece section to vary the distance said core projects from one side of said end wall portion; sliding said core section in said aperture to precisely fix the axial spacing of the ends of said core section and longitudinal portion and locking the same in said adjusted position; mounting said core and heel piece unit upon said bobbin structure so that said core section passes into one end of said core-receiving aperture and projects from the other one end thereof progressively adjusting the position of said core and heel piece unit on said bobbin structure so that said core section projects from said other end of said core-receiving aperture a given predetermined distance; and fixing said core and heel piece unit in said adjusted position.

22. The method of claim 21 wherein said electromagnetic device includes an armature mounted on said longitudinal portion of said heel piece section at said opposite end of said bobbin structure after said core and heel piece unit is fixed in position on said bobbin structure and said armature is mounted on said heel piece section.

23. A method of making an electromagnetic device including a support base having a bobbin structure thereon supporting a conductor winding forming a coil and having a core-receiving aperture passing through said magnetic field generated in said core when the coil is energized, the method comprising first mounting said bobbin structure on said support base, providing a guage means at one end of said bobbin structure; urging said support base toward said guaging means so that said abutment shoulder is urged against a first reference surface on said guaging means facing toward said bobbin structure, said guaging means having a second reference surface spaced from said first reference surface a predetermined distance and facing toward said bobbin structure; providing a core and heel piece unit constituting said magnetic field-directing structure, said core and heel piece unit including a core section and a heel piece section from which said core section extends, mounting said core and heel piece unit upon the other end of said bobbin structure so that said core section passes into the latter end of said core-receiving aperture and projects from the former end thereof, said core and heel piece unit being further adjusted in position on said bobbin structure by pushing the core and heel piece unit into a position where said core section finally abuts said second reference surface which constitutes the finally adjusted position of said core and heel piece unit, and fixing said core and heel piece unit in said adjusted position.

24. The method of claim 21 or 23 wherein said core section of said core and heel piece unit extends from an end wall portion of said heel piece section, said heel piece section having a longitudinal portion extending from said end wall portion thereof on the outside of said bobbin structure, said core section is adjustable in position on said heel piece section so that the end of the core section has an adjustable position with respect to the end of said longitudinal portion which extends beyond said one end of said bobbin structure, and said core section is adjusted into a given predetermined position with respect to said heel piece section of said core and heel piece unit prior to placing said core and heel piece unit upon said bobbin structure.

25. A method of making an electrical plug-in device, said method comprising the steps of: assembling a terminal board assembly comprising an outermost base plate and innermost clamp plate and terminal blade members with intermediate laterally extending portions clamped between said base and clamp plates, outwardly extending portions projecting from said base plate and inwardly extending portions projecting from said clamp plate; mounting upon said clamp plate an electromagnetic device comprising a bobbin structure supporting a conductor winding forming a coil and having a core-receiving aperture passing through said bobbin structure and encircled by said coil; supporting upon said bobbin structure a core and heel piece unit constituting a magnetic field-directing structure for the electromagnetic device, said core and heel piece unit including a core section projecting from a heel piece section and extending through said core-receiving aperture of said bobbin structure; and progressively adjusting the position of said core and heel piece unit on said bobbin structure so that the end face of said core section projects from said core-receiving aperture a given predetermined distance; fixing said core and heel piece unit in said adjusted position; and then mounting an armature at the end of said heel piece section adjacent the end of the bobbin structure from which said core section projects so that the armature upon energization of said coil will be drawn into engagement with said end face of said core section.

26. The method of claim 25 wherein said electromagnetic device is a relay, a movable contact is mounted on said armature, and there is provided on said support base a stationary contact with which the movable contact on the armature makes contact just before the armature makes engagement with the end face of said core section, the adjustment step of said core and heel piece unit including the use of a gauging means having a first reference surface against which the side of said stationary contact is positioned and a second reference surface against which the end face of said core section is positioned when the core and heel piece unit is in its finally adjusted position.

27. In a method of making a relay electromagnetic device including a support base having a bobbin structure thereon supporting a conductor winding forming a coil and having a core-receiving aperture passing through said bobbin structure and encircled by said coil, said support base carrying a stationary contact at one end of said core-receiving aperture, a magnetic field-directing structure for said device including a core in said aperture for carrying the magnetic field generated by the current in said coil, and a movable contact carrying armature at said one end of said core-receiving aperture and mounted for movement between an initial position when said coil is de-energized and a position against said core when drawn by the magnetic field generated in said core when the coil is energized where said stationary and movable contacts make contact with one another, the method comprising: first mounting said bobbin structure on said support base; providing a core and heel piece unit constituting said magnetic field-directing structure, said core and heel piece unit including a core section and a heel piece section from which said core section extends, said core section extending from an end wall portion of said heel piece section, said heel piece section having a longitudinal portion extending from said end wall portion thereof on the outside of said bobbin structure, and on the end of which said armature is or will be mounted, mounting said core and heel piece unit upon said bobbin structure so that said core section passes into the other end of said core-receiving aperture and projects from said one end thereof where said stationary contact is or will be located and said longitudinal portion of said heel piece section extends along the outside of said bobbin structure, and progressively adjusting the position of said core and heel piece unit on said bobbin structure so that said core section projects from said other end of said core-receiving aperture a given predetermined distance; and fixing said core and heel piece unit in said adjusted position.

28. The method of claim 27 wherein said support base and bobbin structure thereon is urged toward a gauging means where the side of said contact to be engaged by said movable contact of said armature is urged against a first reference surface on said gauging means, said gauging means having a second reference surface spaced from said first reference surface by a pre-determined distance, said core and heel piece unit being adjusted in position by pushing the core and heel piece unit upon said bobbin structure into a position where said core finally projects beyond said core-receiving aperture and abuts said second reference surface which constitutes the finally adjusted position of said core and heel piece unit.

* * * * *